US011076686B2

(12) United States Patent
Radney-Gonzalez

(10) Patent No.: US 11,076,686 B2
(45) Date of Patent: Aug. 3, 2021

(54) BARBEQUE CLEANING BRUSH APPARATUS

(71) Applicant: Serritta Radney-Gonzalez, South Holland, IL (US)

(72) Inventor: Serritta Radney-Gonzalez, South Holland, IL (US)

( * ) Notice: Subject to any disclaimer, the term of this patent is extended or adjusted under 35 U.S.C. 154(b) by 342 days.

(21) Appl. No.: 15/957,824

(22) Filed: Apr. 19, 2018

(65) Prior Publication Data

US 2019/0320789 A1 Oct. 24, 2019

(51) Int. Cl.

| | |
|---|---|
| ***A46B 15/00*** | (2006.01) |
| ***A46B 5/00*** | (2006.01) |
| ***A46B 7/04*** | (2006.01) |

(52) U.S. Cl.

CPC ..... *A46B 15/0095* (2013.01); *A46B 5/005* (2013.01); *A46B 7/04* (2013.01); *A46B 2200/3093* (2013.01)

(58) Field of Classification Search

CPC .. A46B 5/00; A46B 5/005; A46B 7/04; A46B 15/00; A46B 15/0095; A46B 17/00; A46B 2200/3093; A47J 37/00; A47J 37/07; A47J 37/10; B65D 83/10; B65D 85/00

USPC ..... 15/105–121, 248.1

See application file for complete search history.

(56) References Cited

U.S. PATENT DOCUMENTS

| | | | | |
|---|---|---|---|---|
| 7,802,566 | B1 * | 9/2010 | Faught | A47J 33/00 126/30 |
| 8,579,114 | B2 * | 11/2013 | Gringer | B65D 75/22 206/361 |
| 8,806,698 | B2 * | 8/2014 | Enders | A47J 37/0786 15/248.1 |

* cited by examiner

*Primary Examiner* — Bryon P Gehman

(57) ABSTRACT

An apparatus for cleaning barbeque grills involves a new and improved barbeque cleaning brush apparatus that has a cover member which houses and protects the brush when not in use. The handle of the cleaning brush is adjustable in length. The cover member is configured to be attached to the side of a barbeque grill.

18 Claims, 8 Drawing Sheets

BARBEQUE CLEANING BRUSH APPARATUS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of barbeque cleaning brushes and more specifically relates to an improved barbeque cleaning brush apparatus.

2. Description of the Related Art

People love to barbeque outdoors. Barbequing is usually done outdoors on charcoal grills or gas grills. As the food cooks on the grill, some of it will stick to the surface of the grill and will need to be cleaned before the next grilling session. The operation of cleaning the grill normally involves a grill brush. The market is currently flooded with barbequing accessories that seek to make the experience of barbequing outdoors on a grill more enjoyable and convenient, chief of which is the grill brush. The barbeque chef who is grilling needs to have tools that are safe to use around an open flame and which will allow the chef to tend to the food without fear of being burned. It is also desirable to have tools that are kept free of dirt and debris or insects that might be attracted by the smell of cooking meat or sweet sauces. Oftentimes tools are left in the open and unprotected between usage and can leave a sticky mess. This is particularly true with a grill brush. It is desirable to have a cover in combination with the grill brush to keep the grill brush clean.

Ideally, a grill brush should provide chefs a way to clean the grilling surface between barbeques without the fear of getting burned, would stay relatively clean between barbeques, be readily accessible to the chef for the next barbeque, would operate reliably and be manufactured at a modest expense. Thus, a need exists for a reliable barbeque cleaning brush apparatus to avoid the above-mentioned problems.

BRIEF SUMMARY OF THE INVENTION

In view of the foregoing disadvantages inherent in the known barbeque accessory art, the present invention provides a novel barbeque cleaning brush apparatus. The general purpose of the present invention, which will be described subsequently in greater detail is to provide an improved barbeque cleaning brush apparatus providing chefs a way to clean the grilling surface between barbeques without the fear of getting burned, would stay relatively clean between barbeques and be readily accessible to the chef for the next barbeque. Some possible names envisioned for this apparatus might perhaps include: Grab-n-Go or Stow-Away or Grill Tool Dock-n-Station or Stow-n-Go to help characterize the ease of use.

The present invention holds significant improvements and serves as an improved barbeque cleaning brush apparatus. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, barbeque cleaning brush apparatus is constructed and operative according to the teachings of the present invention.

The various embodiments of the present invention will hereinafter be described in conjunction with the appended drawings, wherein like designations denote like elements

DETAILED DESCRIPTION

As discussed above, embodiments of the present invention relate to a barbeque accessory and more particularly to an improved barbeque cleaning brush apparatus.

An improved barbeque cleaning brush apparatus is shown having an extensible handle member and a square cover member which has a box shape and can be attached to the surface of a barbeque grill. The barbeque cleaning brush and the cover member are two separate pieces with the barbeque cleaning brush enclosed within the cover member. The cover is envisioned as being universal so that it may be used with most other barbeque cleaning brushes on the market.

The cover may be made from an array of materials including but not limited to stainless steel, thermal heat resistant plastic, wood or other suitable metal. The cover may also be equipped with a silicone heat resistant lining. The cover member may be attached to a grill with commercial grade hook and loop fasteners or a strong magnet or other suitable arrangement such as a top hook which can be made to rotate to hide its presence. Other embodiments of the cover member are envisioned which may conceivably be of a rotating variety and would include more grilling tools.

Figure 1:
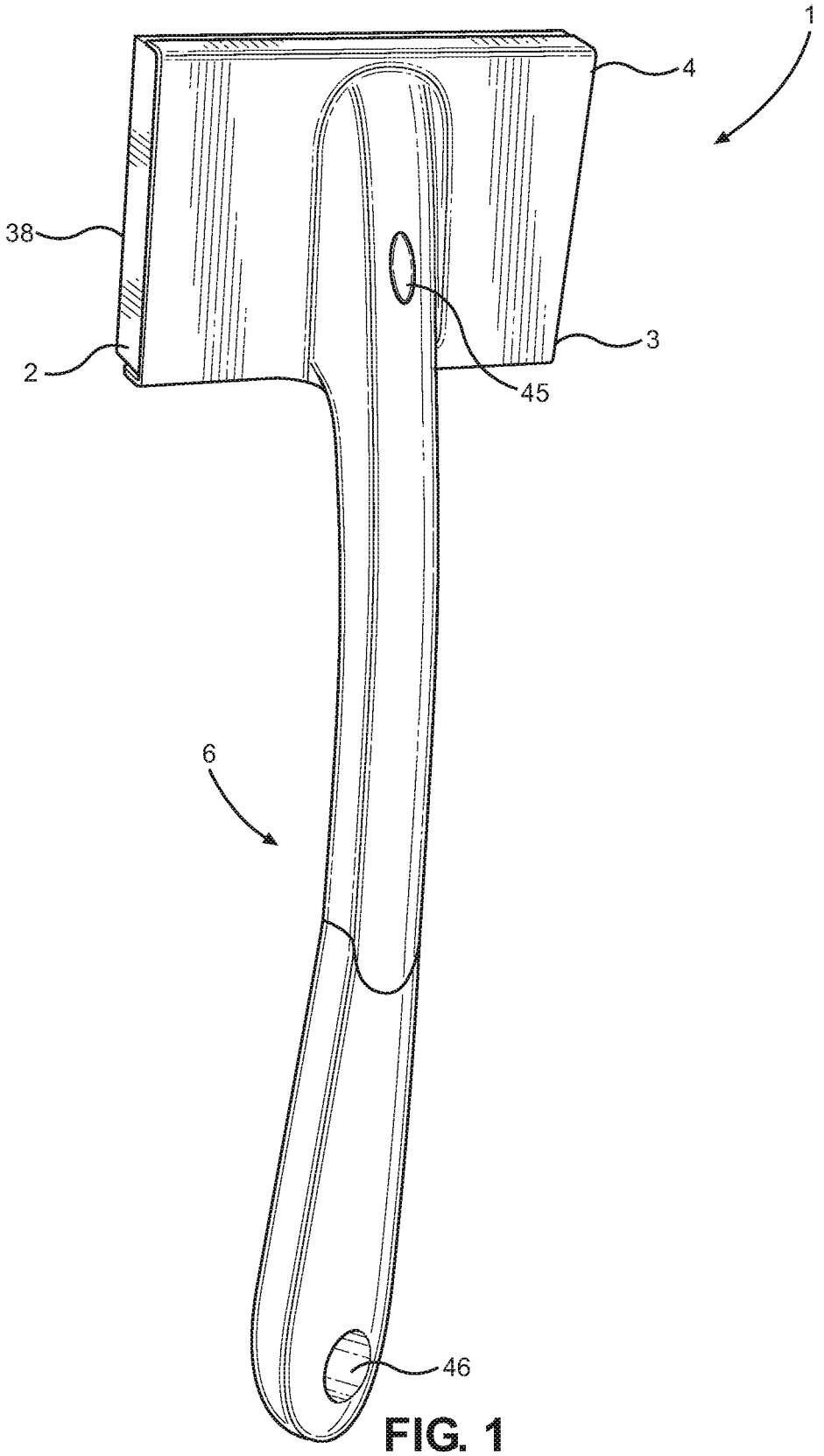
FIG. 1 shows a perspective view illustrating the improved barbeque cleaning brush apparatus according to an embodiment of the present invention.
Figure 2:
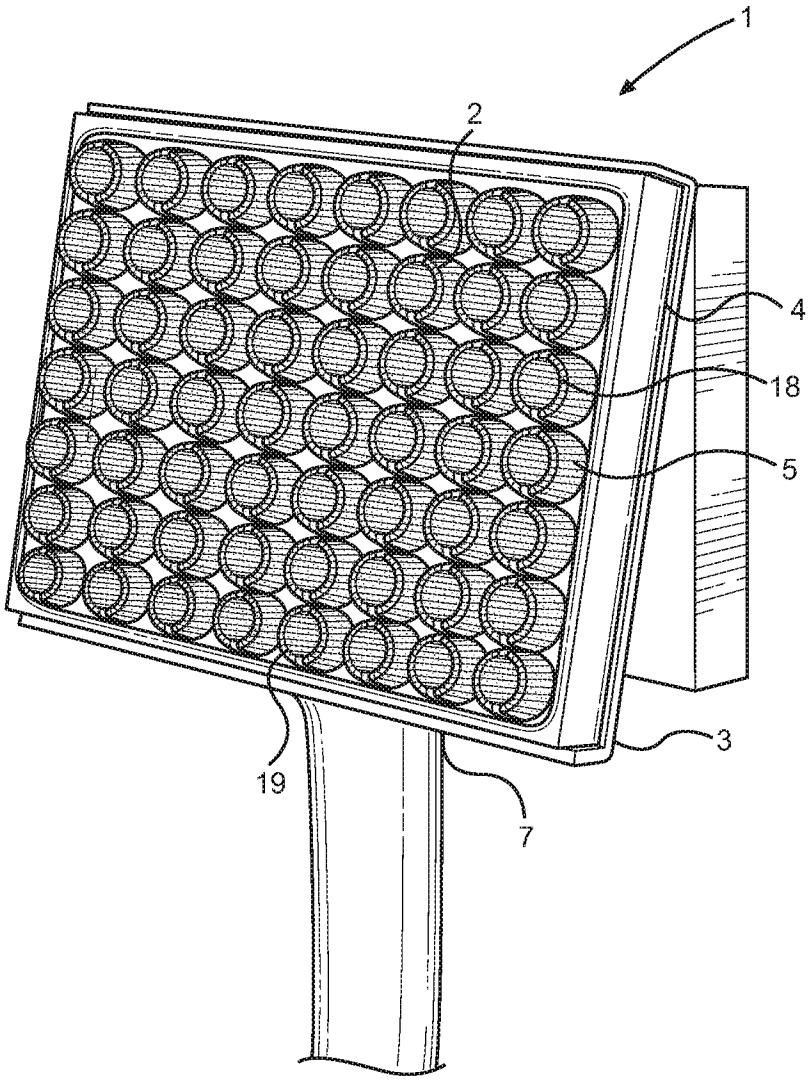
FIG. 2 is a perspective view illustrating the head member of the improved barbeque cleaning brush apparatus according to an embodiment of the present invention of FIG. 1.
Figure 3:
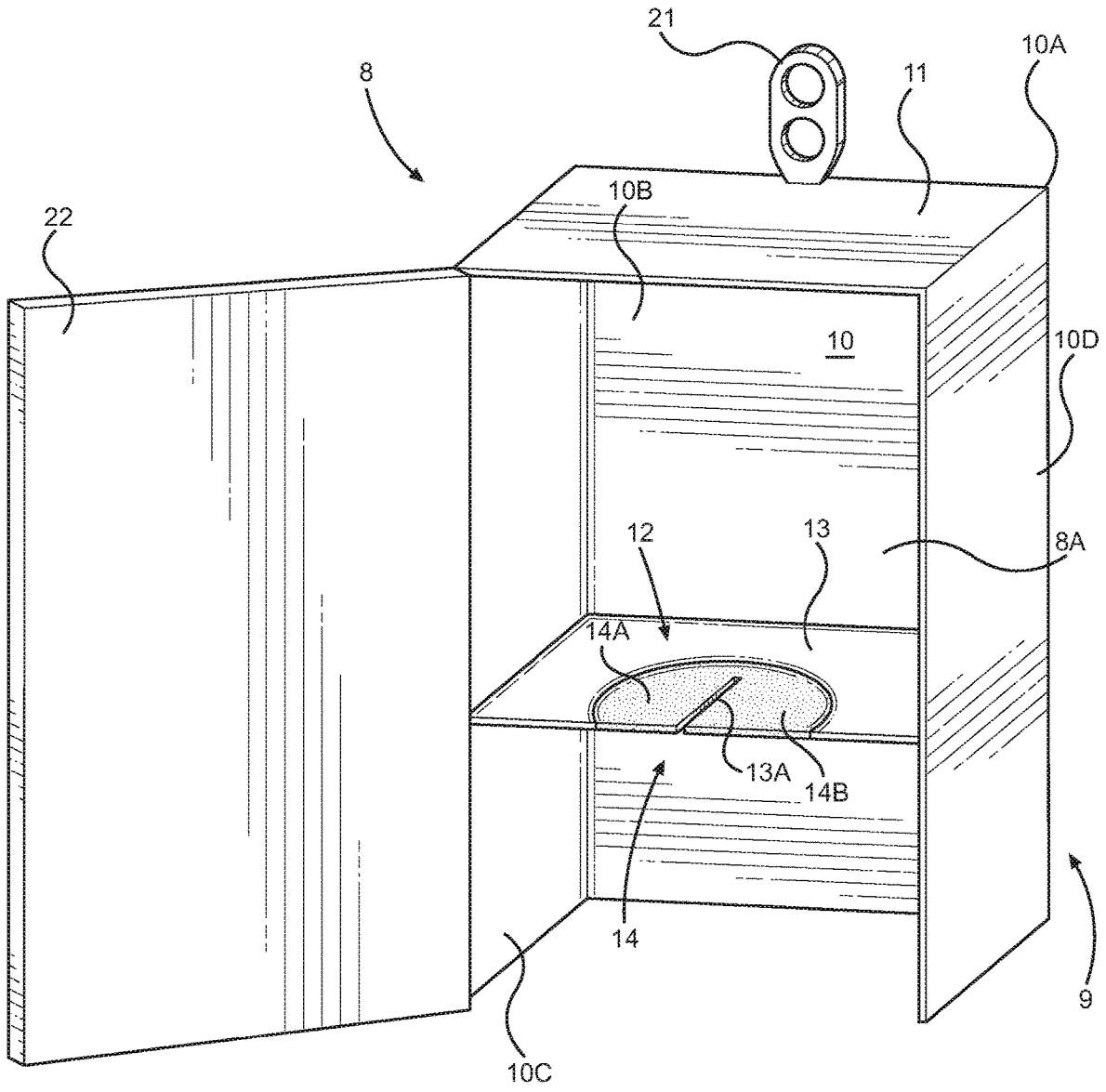
FIG. 3 is a perspective view illustrating the cover member of the improved barbeque cleaning brush apparatus according to an embodiment of the present invention of FIG. 1.
Figure 4:
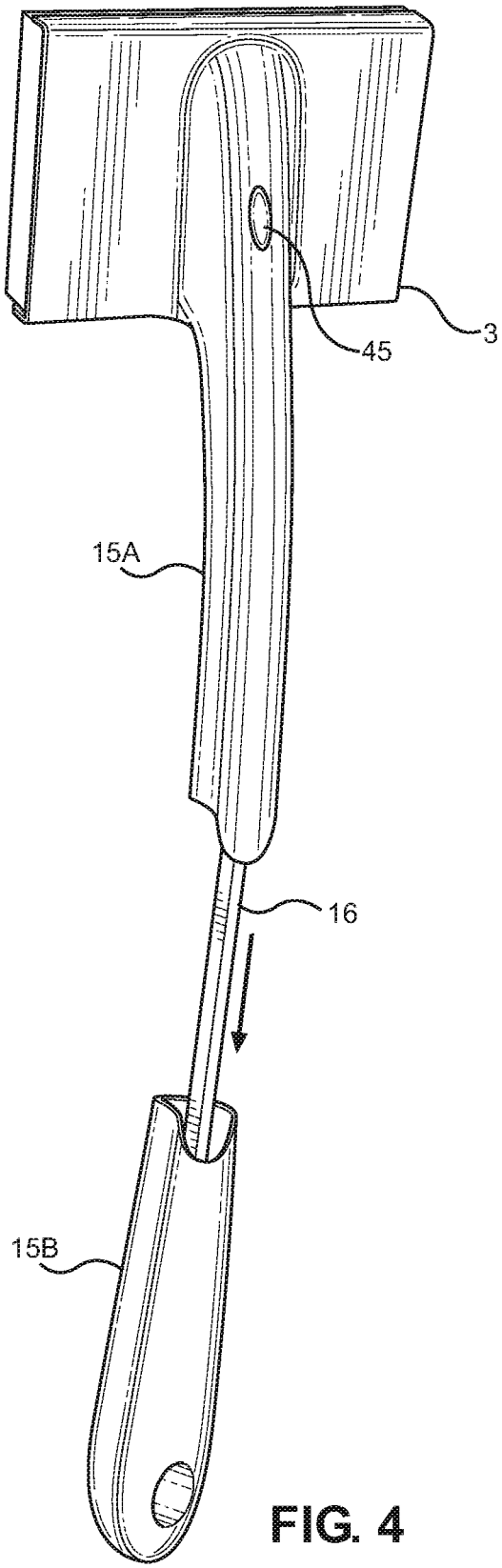
FIG. 4 is a perspective view illustrating the extensible handle of the improved barbeque cleaning brush apparatus according to an embodiment of the present invention of FIG. 1.
Figure 5:
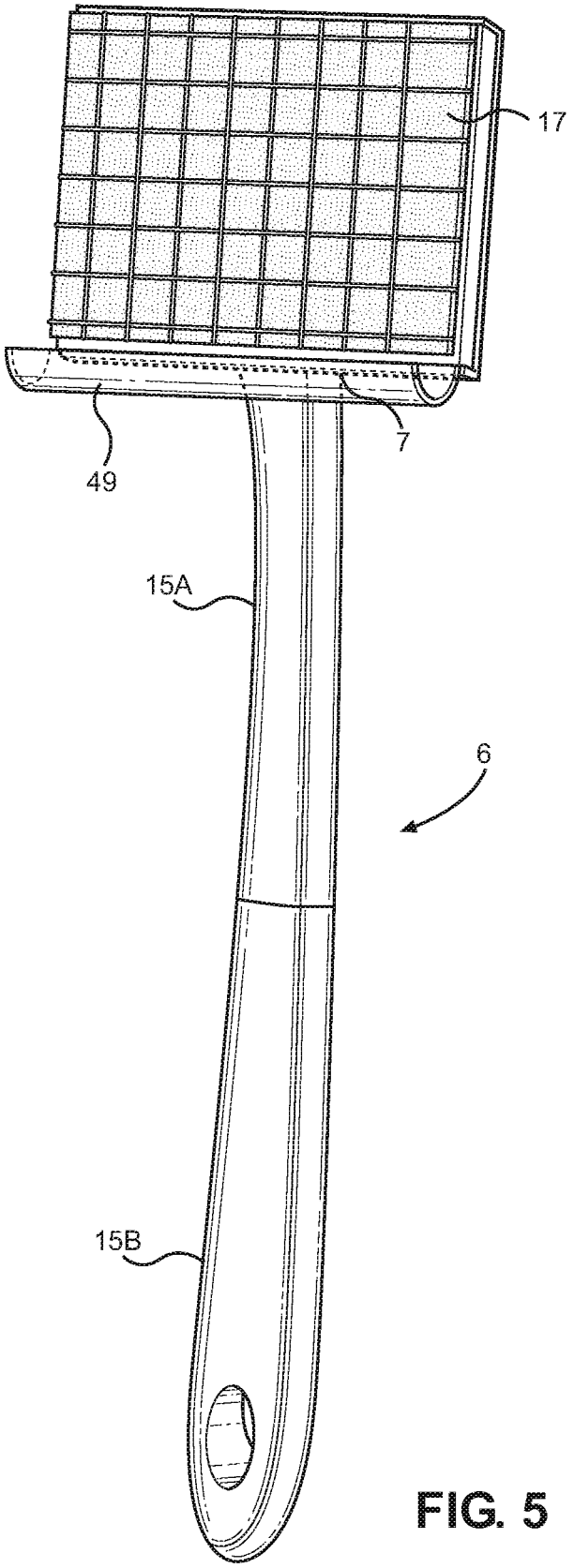
FIG. 5 is a perspective view of a different cleaning head of the improved barbeque cleaning brush apparatus according to an embodiment of the present invention of FIG. 1.
Figure 6:
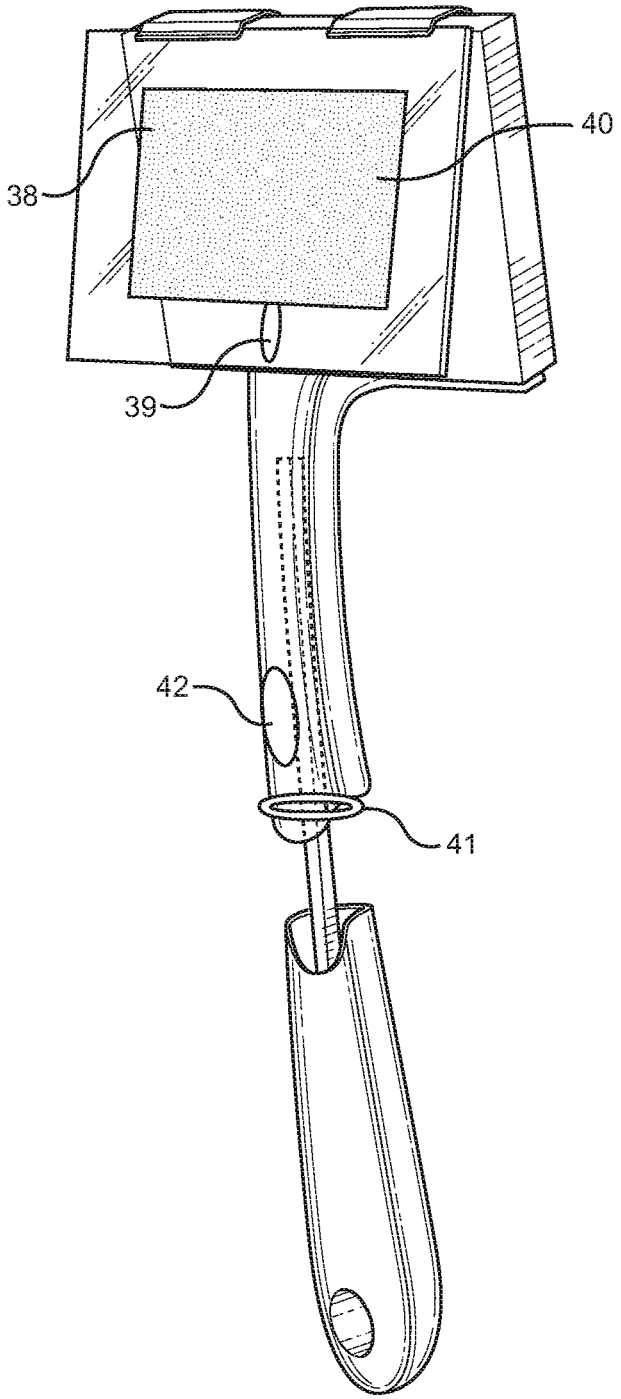
FIG. 6 illustrates how the pivotal cover attaches magnetically to the handle when in the open position.
Figure 7:
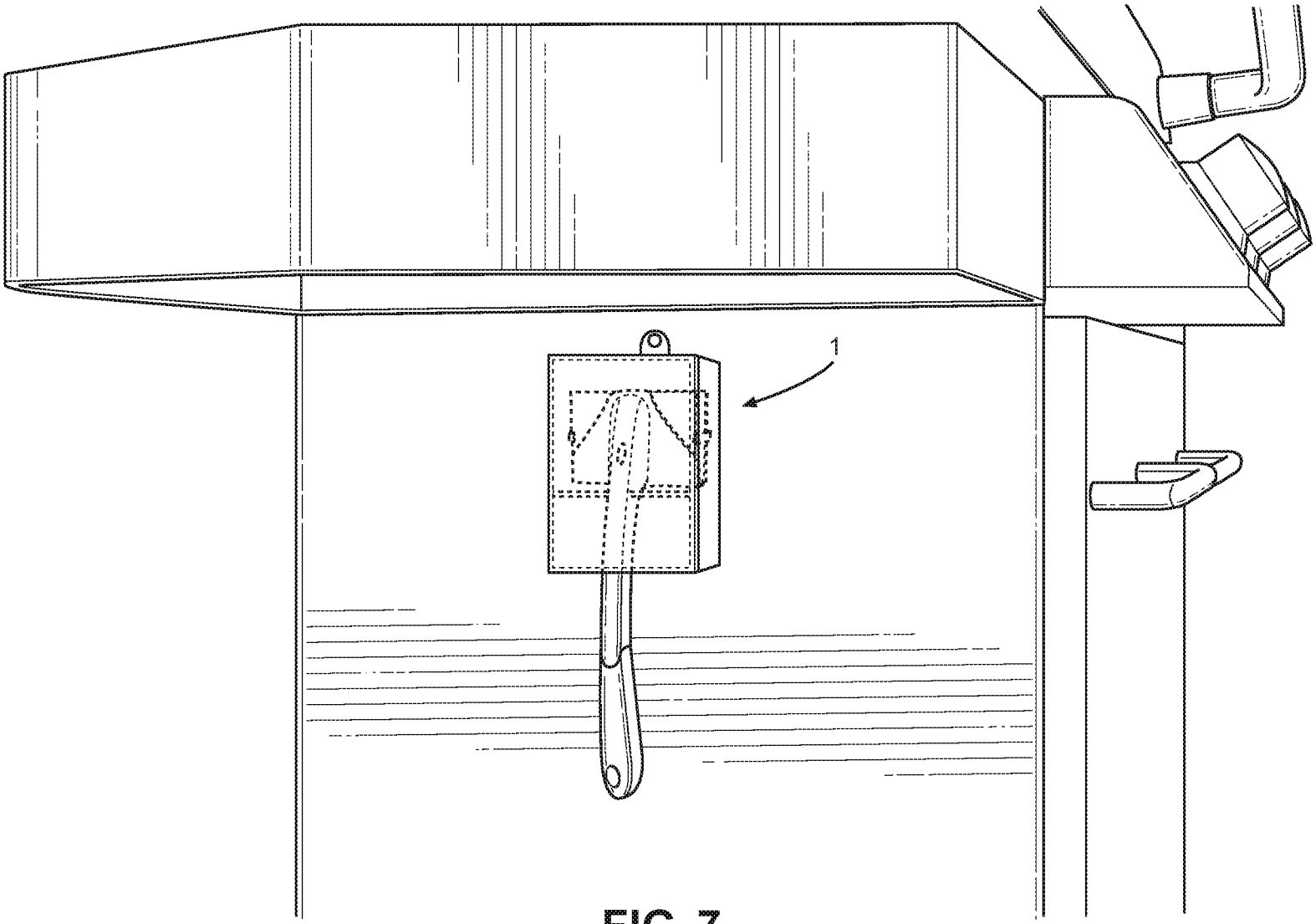
FIG. 7 is a perspective view of the improved barbeque cleaning brush apparatus according to another embodiment wherein the cover and brush are all-in-one according to an embodiment of the present invention of FIG. 1.
Figure 8:
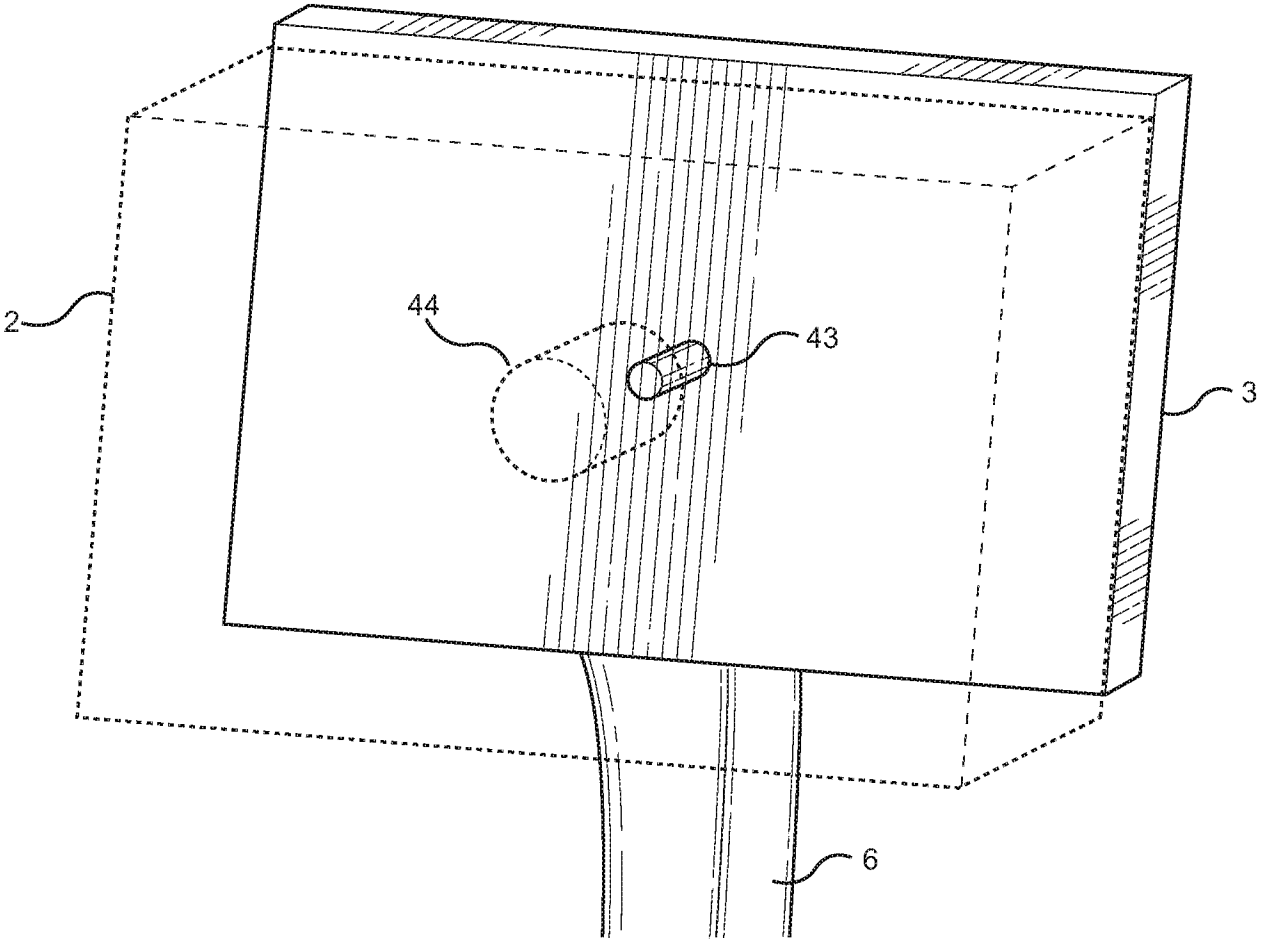
FIG. 8 is an exploded view of the improved barbeque cleaning brush apparatus brush head according to an embodiment of the present invention of FIG. 1.
Figure 9:
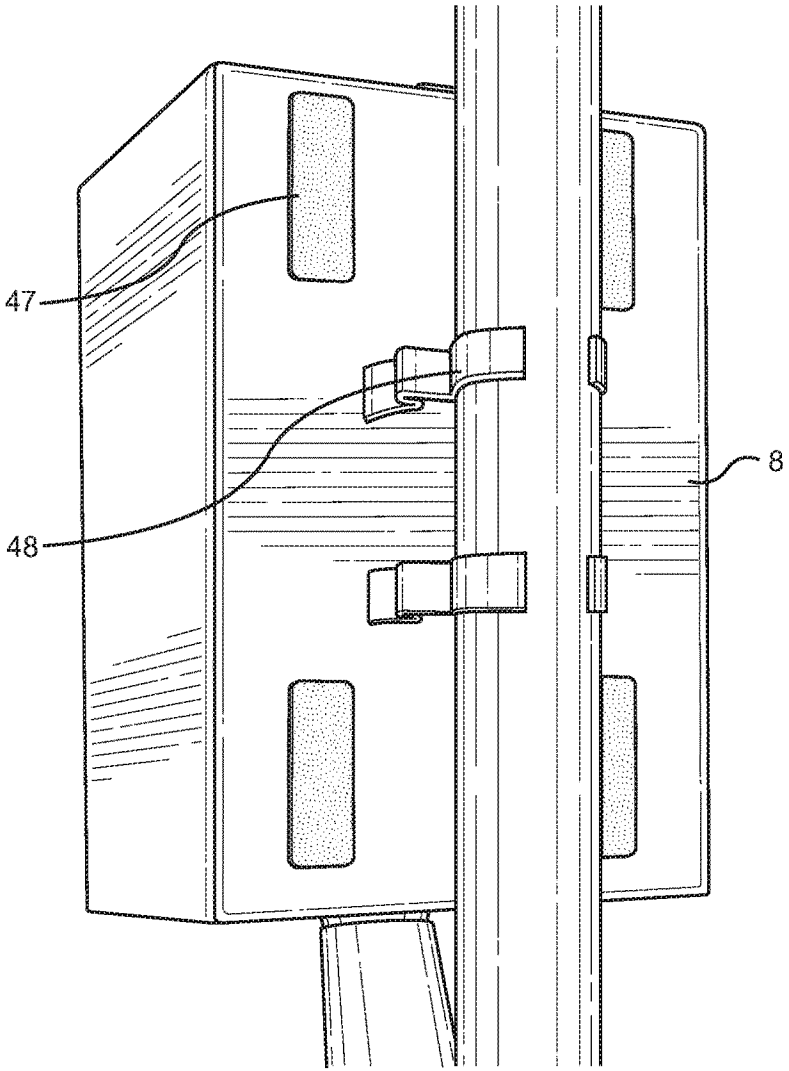
FIG. 9 is a rear view of the cover member showing attachment members for use on a barbeque apparatus according to an embodiment of the present invention of FIG. 1.

Referring to the drawings by numerals of reference there is shown in FIGS. 1-9, an improved barbeque cleaning brush apparatus 1 having a cover member 8 and a brush member 2 which complements the cover member 8.

The brush member 2 includes an interchangeable head member 3. The preferred embodiment shows an interchangeable head member 3 including a flat cleaning panel member 4 and a cleaning member 5. It is envisioned that the interchangeable head member 3 may include tongs or a spatula. In the embodiment shown, the cleaning member 5 is releasably attached to the flat cleaning panel member 4 and is adapted to clean barbeque cooking grates. A cover panel 38 is pivotally attached to the interchangeable head member 3 and protects the cleaning member 5 when not in use.

The head member 3 is releasably attached to the brush member 2 via a peg member 43 on the head member 3 releasably engaging a movable brush member catch member 41 on the brush member 2. The brush member catch member 41 is movably controlled via a brush member release button 45 on a handle member 6.

The handle member 6 is attached to the interchangeable head member 3 at a proximal end 7 of the handle member 6. The head member 3 is easily detachable for replacement heads. The handle member 6 includes a soft coating and an aperture through a distal end for hanging the improved barbeque cleaning brush apparatus 1 during storage.

The present invention features a cover member 8 which includes a main body 9. The main body 9 includes a side-wall member 10 and a top wall member 11. The top wall member 11 is connected to a top portion 10A of the side-wall member 10.

The side-wall member 10 has first and second opposed side walls 10C and 10D respectively and further has a cover member cover panel 22 hingedly attached to the first opposed side wall 10C. The cover member 8 forms a generally rectangular box wherein the cover member cover panel 22 is adapted to open and close easily. The side-wall member 10 includes an attachment member 21 on its outer surface. The attachment member 21 is illustrative only and is either a magnet 47, a hook 21, a clip or hook and loop material 48 or some other suitable attachment for attaching the cover member 8 to a grill surface.

The top wall 11 and the side-wall member 10 form an interior volume 8A which is adapted to house within itself the interchangeable head member 3 which has a rectangular cross section. The featured cover member 8 also has a holding member 12 which includes a rigid portion 13 and a flexible portion 14. The flexible portion 14 is attached to a center portion 13A of the rigid portion 13 and is adapted to releasably retain the handle member 6. The flexible portion 14 of the holding member 12 includes two flexible members 14A and 14B formed for silicon each connected to the rigid portion 13 and adjacent to one another and adapted to releasably retain the handle member 6 therebetween.

The holding member 12 is located within the interior volume 8A and is attached to an interior surface 10B of the side-wall member 10. The flexible portion 14 retains the handle member 6 such that the interchangeable head member 3 of the brush member 2 is located within and protected by the cover member 8.

The extensible handle member 6 is formed from two handle portions 15A and 15B which are adjustably connected to one another to adjust the length of the handle member 6 via a center bar member 16 which is connected to one of the two handle portions 15B and slidably connected to the second one of the two handle portions 15A. The handle member 6 can be extended for use and shortened for storage. The two handle portions 15A and 15B are adjustably connected to one another via a handle catch member 41 which is controlled by a handle release button 42 on one of the two handle portions 15A and 15B.

The cleaning member 5 of the barbeque cleaning brush apparatus 1 includes steel ribbon bristles 18. The steel ribbon bristles 18 are formed having a C-shape 19 to hug the grill. Alternately, the cleaning member 5 includes an abrasive cleaning panel member 17 having an abrasive material on its outer surface. The cleaning member 5 could also have U-shaped bristles.

The handle member 6, the flat cleaning panel member 4 of the brush member 2, the side-wall member 10 and the top wall member 11 of the cover member 8 are formed of either aluminum, steel, stainless steel, copper or ceramic or other suitable heat resistant material.

A portion of the handle member 6 of the brush member 2 is formed from a metallic material. The cover panel 38 includes a magnetic member 39 attached to an outer surface of the cover panel 38 to releasably attach to the metal portion of the handle member 6, such that when in use said cover panel 38 pivots away from said cleaning member 5 and releasably attaches to the metal portion of the handle member 6, and when use is completed the cover panel 38 is released from said metal portion of said handle member 6 and pivoted back onto said cleaning member 5.

The cover panel 38 of the brush member 2 further includes a heat resistant liner 40 attached to an inner surface to cover the cleaning member 5 and protect a user from burns when said cleaning member is hot after use.

Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved barbeque cleaning brush apparatus comprising: a brush member including: a head member including:

a flat cleaning panel member; a cleaning member; wherein said cleaning member is releasably attached to said flat cleaning panel member and is adapted to clean barbeque cooking grates;

a handle member including: wherein said handle member is attached to said head member at a proximal end thereof; and a cover member including a main body including: at least one side wall member; a top wall member, wherein said top wall member is connected to a top portion of said at least one side wall member;

wherein said at least one side wall member and said top wall member form an interior volume adapted to house said head member therein;

a holding member including: a rigid portion; and a flexible portion;

wherein said flexible portion is attached to a center portion of said rigid portion and is adapted to releasably retain said handle member;

wherein said holding member is located within said interior volume and is attached to an interior surface of said at least one side wall member; wherein when said flexible portion retains said handle member is located within and protected by said cover member.

2. The improved barbeque cleaning brush apparatus of claim 1, wherein said handle portion is formed from two handle portions adjustably connected to one another to adjust the length thereof.

3. The improved barbeque cleaning brush apparatus of claim 2, wherein said two handle portions are adjustably connected to one another via a center bar member connected to one of said two handle potions and slidably connected to a second one of said two handle portions to adjust the length thereof.

4. The improved barbeque cleaning brush apparatus of claim 2, wherein said two handle portions are adjustably connected to one another via a catch member there between controlled by a release button on one of said two handle portions.

5. The improved barbeque cleaning brush apparatus of claim 1, wherein said cleaning member includes stainless steel ribbon bristles.

6. The improved barbeque cleaning brush apparatus of claim 5, wherein each of said steel ribbon bristles is formed having a C-shape.

7. The improved barbeque cleaning brush apparatus of claim 1, wherein said at least one side wall member includes at least one attachment member on and outer surface thereof adapted to releasably connect to a barbeque apparatus; and wherein said at least one attachment member is chosen from a group of attachment members consisting of a magnet, a hook, a clip and hook and loop material.

8. The improved barbeque cleaning brush apparatus of claim 1, wherein said flexible portion of said holding member includes two flexible members each connected to said rigid portion adjacent to one another and adapted to releasably retain said handle member there between.

9. The improved barbeque cleaning brush apparatus of claim 8, wherein said two flexible members are formed from silicon.

10. The improved barbeque cleaning brush apparatus claim 1, wherein said head member is formed having a rectangular cross section; and wherein said interior volume formed by said at least one side wall member and said top wall member form a rectangular interior volume adapted to house said head member therein.

11. The improved barbeque cleaning brush apparatus of claim 1, wherein said handle member and said flat cleaning panel member of said brush member and said at least one side wall member and said top wall member of said cover member are formed from a material chosen from a group of materials consisting of aluminum, steel, stainless steel, copper and ceramic.

12. The improved barbeque cleaning brush apparatus of claim 1, wherein said cleaning member incudes a cleaning panel member having an abrasive material on an outer surface thereof.

13. The improved barbeque cleaning brush apparatus of claim 1, wherein said brush member further includes a cover panel pivotally attached to said head member and adapted to removably cover and protect said cleaning member.

14. The improved barbeque cleaning brush apparatus of claim 13, wherein a portion of said handle member of said brush member is formed from a metal material; and wherein said cover panel includes a magnetic member attached to an outer surface thereof adapted to releasably attach to the metal portion of said handle member, such that when in use said cover panel pivots away from said cleaning member and releasably attaches to said metal portion of said handle member and when use is completed said cover panel is released from said metal portion of said handle member and pivoted back onto said cleaning member.

15. The improved barbeque cleaning brush apparatus of claim 13, wherein said cover panel of said brush member further includes a heat resistant liner attached to an inner surface thereof and adapted to cover said cleaning member and protect a user from burns when said cleaning member is hot after use.

16. The improved barbeque cleaning brush apparatus of claim 1, wherein said cover member further includes a cover panel pivotally attached to said at least one side wall member and adapted to enclose and protect said brush member.

17. The improved barbeque cleaning brush apparatus of claim 1, wherein said head member is releasably attached to said brush member via peg member on said head member releasably engaging a movable catch member on said brush member; and wherein said catch member is movably controlled via a release button on said handle member.

18. The improved barbeque cleaning brush apparatus of claim 1, wherein said handle member includes a soft coating thereon, and an aperture through a distal end thereof for hanging the improved barbeque cleaning brush apparatus during storage.

* * * * *